US011235449B2

(12) United States Patent
Macchieraldo

(10) Patent No.: US 11,235,449 B2
(45) Date of Patent: Feb. 1, 2022

(54) QUICK-RELEASE SETTING TOOL FOR AN ELEMENT TO BE CRIMPED

(71) Applicant: BOLLHOFF OTALU S.A., La Ravoire (FR)

(72) Inventor: David Macchieraldo, Traize (FR)

(73) Assignee: BOLLHOFF OTALU S.A., La Ravoire (FR)

( * ) Notice: Subject to any disclaimer, the term of this patent is extended or adjusted under 35 U.S.C. 154(b) by 474 days.

(21) Appl. No.: 16/310,572

(22) PCT Filed: Jun. 16, 2017

(86) PCT No.: PCT/FR2017/051590
§ 371 (c)(1),
(2) Date: Dec. 17, 2018

(87) PCT Pub. No.: WO2017/216504
PCT Pub. Date: Dec. 21, 2017

(65) Prior Publication Data

US 2019/0240819 A1 Aug. 8, 2019

(30) Foreign Application Priority Data

Jun. 16, 2016 (FR) ..... 1655604

(51) Int. Cl.
*B25B 27/00* (2006.01)
*B25B 23/00* (2006.01)

(52) U.S. Cl.
CPC ..... *B25B 27/0014* (2013.01); *B25B 23/0007* (2013.01)

(58) Field of Classification Search
CPC . B25B 27/0014; B25B 23/0007; B25B 27/14; B21J 15/16; B21J 15/26; B21J 15/383
See application file for complete search history.

(56) References Cited

U.S. PATENT DOCUMENTS

2013/0104360 A1* 5/2013 Liu ..... B21J 15/18 29/243.523

FOREIGN PATENT DOCUMENTS

EP 3067157 A1 * 2/2016
FR 3011759 A1 4/2015

OTHER PUBLICATIONS https://web.archive.org/web/20100626084258/https://en.wikipedia.org/wiki/List_of_screw_drives (Year: 2010).*

(Continued)

*Primary Examiner* — Mahdi H Nejad
(74) *Attorney, Agent, or Firm* — Oliff PLC

(57) ABSTRACT

A setting tool includes: a body with at least a drive shaft connected to a pull rod designed to be screwed onto the crimp part, to drive the pull rod in rotation along an axis; a draw sleeve fixed to the body and connected to the pull rod, to translate the pull rod along the axis; and a placing nose, to house the pull rod rear end, the drive shaft front end, and the draw sleeve. The draw sleeve front end includes a cavity opening onto a first through hole on the side wall, and a second hole on the drive shaft axis of rotation, the through holes allow the pull rod front end to pass through the holes, to allow the pull rod rear end to pass through the first through hole, and to enable the pull rod to be placed along the drive shaft axis of rotation.

16 Claims, 6 Drawing Sheets

(56) References Cited

OTHER PUBLICATIONS

Oct. 4, 2017 International Search Report issued in International Patent Application No. PCT/FR2017/051590.
Oct. 4, 2017 Written Opinion issued in International Patent Application No. PCT/FR2017/051590.

* cited by examiner

QUICK-RELEASE SETTING TOOL FOR AN ELEMENT TO BE CRIMPED

FIELD OF THE INVENTION

The invention relates to a setting tool for fitting a crimp part, equipped with a quick-release pull rod. The invention also relates to the method for assembling the setting tool.

STATE OF THE ART

The use of crimp parts is commonplace in industry, and in particular in the automobile, aeronautic or naval construction fields. A large variety of crimp parts such as clinch nuts are used.

Crimping of parts is generally performed by means of portable setting tools using an oleo-pneumatic, electric or other form of power. This type of setting tool is equipped with a pull rod designed to be screwed into or around the crimp part. The tool is also provided with a system for driving in rotation and a pulling system for performing screw-tightening and crimping of the crimp part.

More precisely, to crimp a part such as a nut on a plate, the body of the nut is first inserted through a hole of the plate. The pull rod of the tool, advantageously comprising an external thread, is then screwed into the body of the nut. When the pull rod is fully tightened, a pulling system integrated in the tool performs crimping of the crimp part. This step consists in pulling the body of the nut in the direction of the plate so as to form a rim against the plate in order to crimp the nut. The pull rod is then unscrewed, and the assembly comprising the nut and plate is ready to be assembled to an external element.

For the setting tool to be versatile, it is important for the pull rod to be easily interchangeable so as to match the internal or external thread of the crimp part, and also its diameter and length. Interchangeability of the pull rod is also important for performing maintenance of the equipment in case of wear or breakage of the rod.

French Patent FR 3011759 in the name of the applicant discloses an setting tool comprising a drive shaft provided with an axial groove having a specific shape. At the front, i.e. the side where the working area is located, the groove has a smaller lateral dimension than at the back, i.e. on the side opposite the working area. The drive shaft collaborates with a pull rod comprising a larger rear area than the front area, and which has dimensions matching the width of the groove to prevent any lateral clearance. To fit the pull rod in position on the setting tool, no tooling is required, the pull rod simply has to be inserted in the groove. The pull rod is therefore easily interchangeable according to the user's requirements.

However the groove does provide the pull rod with a degree of lateral freedom, and the pull rod could move slightly in spite of the placing nose being fixed around the drive shaft and the pull rod. This can give rise to asymmetric forces when crimping of the nut is performed, and the latter may not be perfectly orthogonal to the plate to which it is fixed.

OBJECT OF THE INVENTION

One object of the invention is to provide an setting tool comprising a placing nose provided with a pull rod that is able to be easily and quickly interchanged and which exerts perfectly symmetrical forces when crimping of the crimp part is performed.

For this purpose, the setting tool comprises:

- a body comprising at least a drive shaft connected to a pull rod designed to be screwed onto the crimp part, the pull rod comprising a front end and a rear end, the rear end having a larger cross-section than the front end,
  - the front end of the drive shaft and the rear end of the pull rod being configured so that a rotation of the drive shaft along an axis AA results in a rotation of the pull rod along the axis AA,
- a draw sleeve comprising a rear end fixed to the body and connected to the pull rod,
  - the draw sleeve and the rear end of the pull rod being configured so that a translation of the draw sleeve along the axis AA results in a translation of the pull rod along the axis AA,
- a placing nose comprising a rear end fixed to the body, the placing nose internally demarcating an open chamber opening out at both ends, the chamber being configured to house the rear end of the pull rod, the front end of the drive shaft, and the draw sleeve.

The invention is remarkable in that the draw sleeve comprises a cavity housing the rear end of the pull rod, the cavity opening onto a first through hole on the side wall and a second through hole on the axis of rotation AA of the drive shaft, the first and second through holes being configured to allow

- the front end of the pull rod to pass through the first and second through holes,
- the rear end of the pull rod to pass through the first through hole,
- the pull rod to be placed along the axis of rotation AA of the drive shaft.

According to one feature of the invention, the rear wall of the pull rod can comprise a pattern configured to collaborate with a complementary pattern of the drive shaft.

Furthermore, the second hole may not define a surface of revolution on the axis of rotation AA of the drive shaft.

Advantageously, the pull rod can comprise a shoulder having a complementary shape to the shape of the draw sleeve in an area located towards the front, the shapes being tapered towards the rear.

In this case, the shoulder can have a rotational symmetry along the first axis, and the draw sleeve can be mechanically dissociated from the drive shaft so that the draw sleeve remains fixed when a rotation of the pull rod takes place.

In preferred manner, the placing nose can comprise a casing inside which the chamber is located, an anvil positioned at a front end of the placing nose, and adjustment means of the travel of the pull rod placed between the casing and the anvil and configured to block the relative position of the anvil with respect to the casing. The adjustment means of the travel of the pull rod can consist of a locknut.

In an advantageous embodiment, the pull rod comprises a first imprint and the drive shaft comprises a second imprint, the first and second imprints being configured:

- to make the pull rod rotate along the axis of rotation when the first and second imprints are mechanically coupled,
- to prevent the pull rod from being separated from the drive shaft by sliding by means of a force perpendicular to the axis of rotation when the first and second imprints are mechanically coupled.

Preferentially, one of the imprints is in the form of a cross or a star. As an alternative, one of the imprints is in the form of a polygon.

In another development, the drive shaft is mounted movable in translation along its axis of rotation to couple or uncouple the first imprint with/from the second imprint.

The invention also relates to a method for assembling an setting tool provided with the above-mentioned features, and comprising the following steps:

inserting the pull rod in the cavity of the draw sleeve through the first hole up to the second hole, placing the pull rod along the axis of rotation AA of the drive shaft, connecting the pull rod to the drive shaft, fixing the placing nose on the body.

The method can also comprise an adjustment step of the adjustment means on the casing so as to limit the travel of the pull rod.

When the rear wall of the pull rod comprises a pattern, and when the rear wall of the cavity comprises a complementary pattern, the method for assembling the setting tool can comprise an assembly step of the pattern and of the complementary pattern.

It is advantageous to provide for the method to comprise a first step of translation of the drive shaft along the axis of rotation of the drive shaft to reduce the space occupation of the drive shaft along the axis of rotation and to place the pull rod on the axis of rotation.

Advantageously, the method comprises a second step of translation of the drive shaft along the axis of rotation of the drive shaft to couple the first imprint with the second imprint.

BRIEF DESCRIPTION OF THE DRAWINGS

Other advantages and features will become more clearly apparent from the following description of particular embodiments of the invention given for non-restrictive example purposes only and represented in the accompanying drawings, in which.

DETAILED DESCRIPTION

An setting tool for placing a crimp part such as the one represented in the figures is provided with a body 1, a placing nose 2 able to be formed by one or more parts being fixed thereon.

The placing nose 2 defines an open chamber 3 which opens out at its two opposite ends to allow a pull rod 4 to pass through. The placing nose 2 has a front end, which is the end located on the working area side, and a rear end located on the opposite side from the working area. Both ends of the placing nose 2 are provided with an opening connected to the chamber 3 to allow the pull rod 4 to pass when assembly or disassembly of the latter is performed.

The pull rod 4 is configured to be mechanically coupled with the crimp part. In this way, the movements made and the forces applied by the pull rod 4 are transferred to the crimp part.

Advantageously, the pull rod 4 is configured to be screwed into or around the crimp part and to then be unscrewed when crimping is performed. For this, the pull rod 4 can, at its front end 4*a*, comprise either an internal or an external thread, or both, to enable crimping of two types of crimp parts having different properties.

Figure 1:
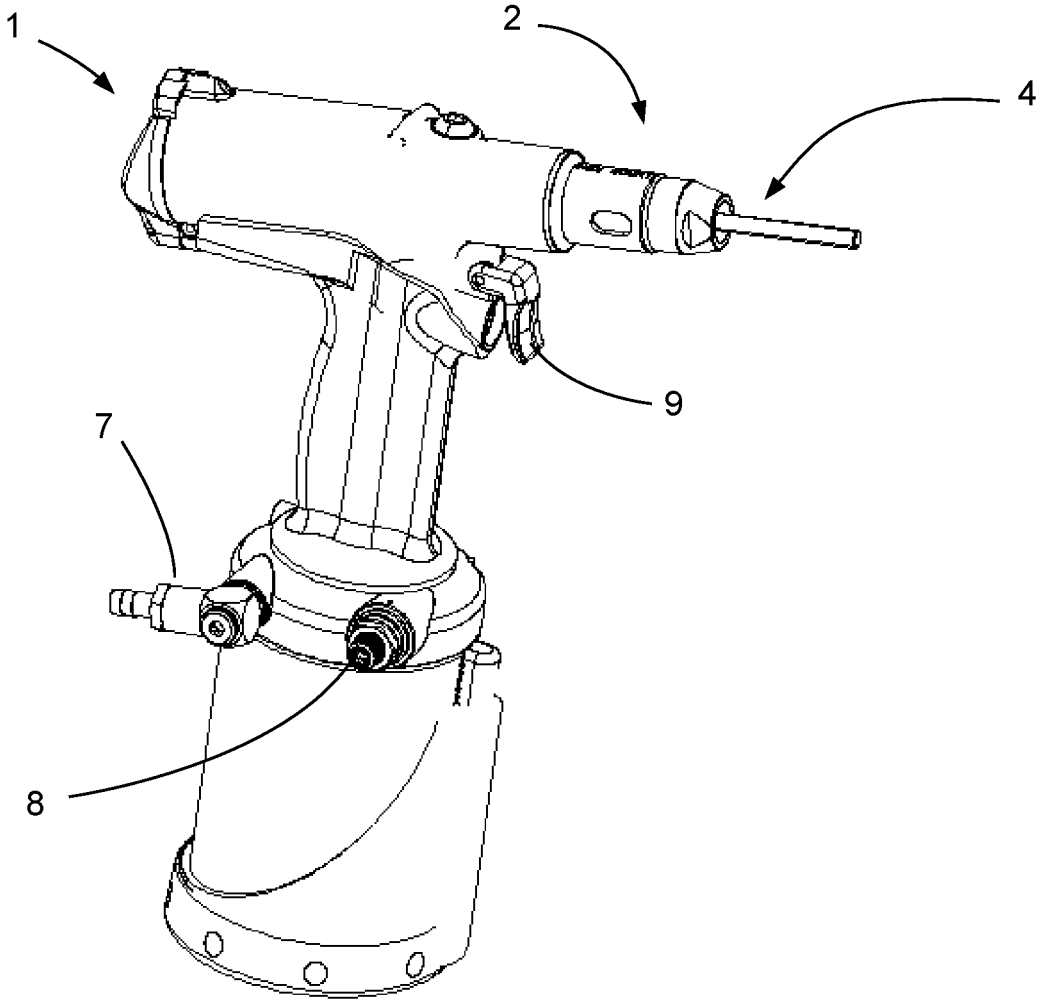
FIG. 1 schematically illustrates a particular embodiment of an setting tool, in perspective view.
Figure 2:
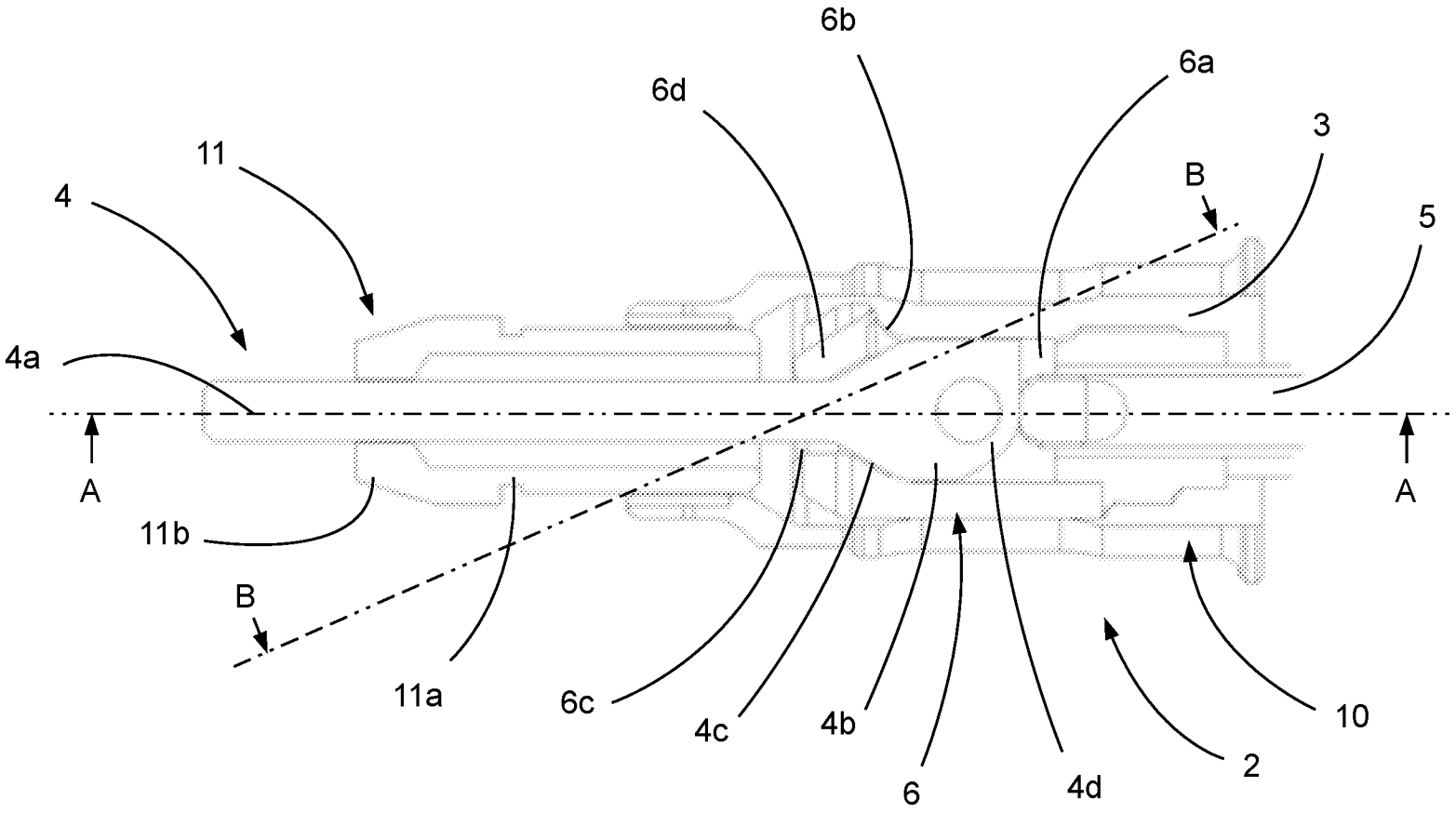
FIG. 2 is a longitudinal sectional view of the placing nose according to the embodiment of FIG. 1, FIGS. 3 to 9 represent fitting steps of the placing nose of the tool.

The pull rod 4 also comprises a rear end 4*b* mechanically connected to a drive shaft 5 that is movable only along an axis of rotation AA (cf. FIG. 2). The pull rod 4 and drive shaft 5 are advantageously fitted in coaxial manner so as to present the same axis of rotation AA to facilitate rotation of the crimp part.

The front end 4*a* and rear end 4*b* of the pull rod can advantageously be formed in monoblock manner. This configuration guarantees the solidity of the pull rod 4 and facilitates interchangeability of the rod during maintenance operations of the setting tool.

Figure 3:
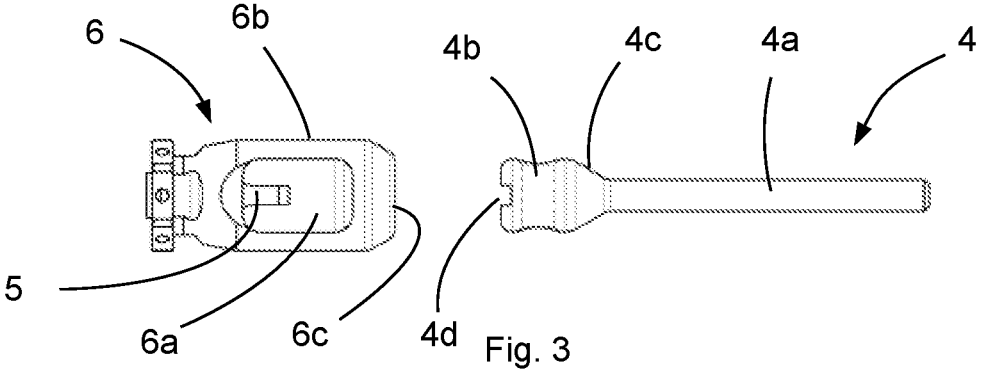
Figure 7:
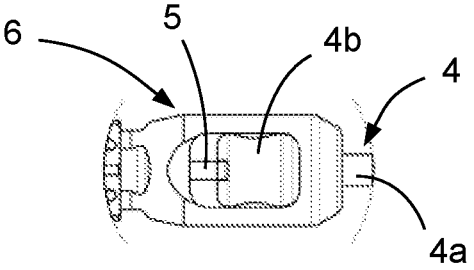
Figure 8:
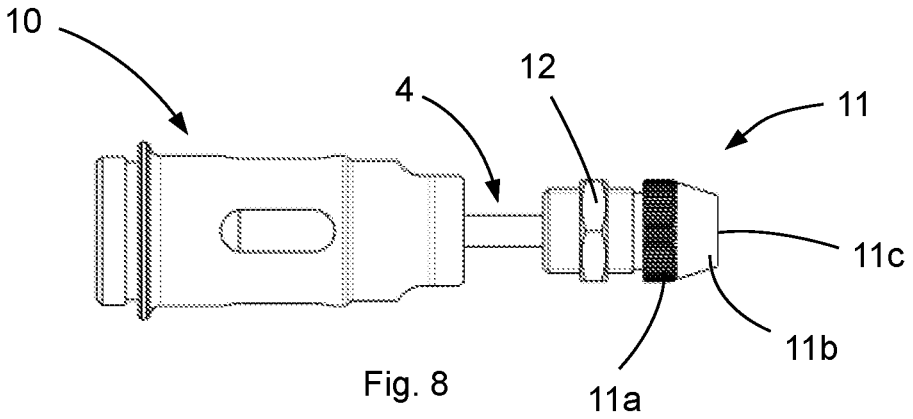
Figure 9:
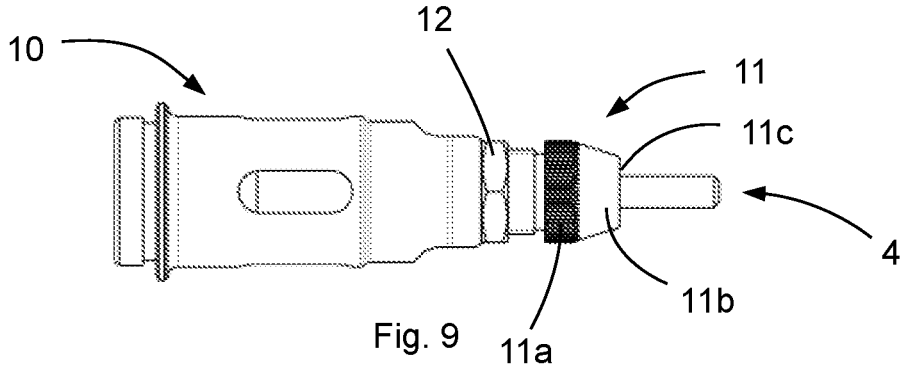
Figure 10:
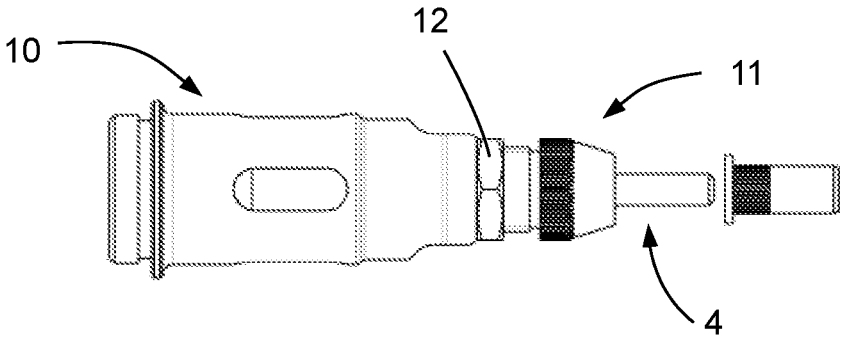
FIGS. 10 and 11 represent steps of use of the tool to crimp a part.
Figure 11:
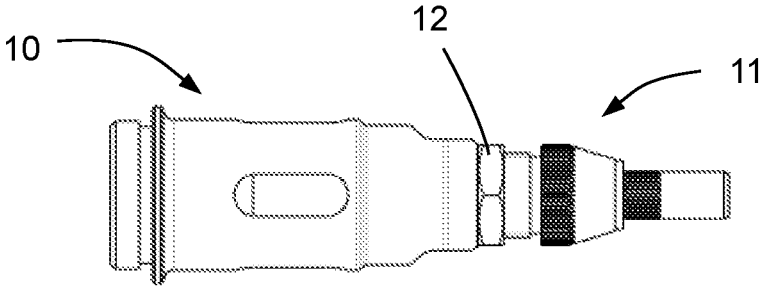

So that the pull rod 4 can be driven in rotation by the drive shaft, the rear surface of the rod 4 comprises a pattern not presenting a rotational symmetry of axis AA. The pattern can fit snugly without clearance in a complementary pattern provided on the front end of the drive shaft 5 (cf. FIGS. 3 and 7).

According to an embodiment illustrated in figures, the pattern can be a groove 4*d* and the complementary pattern can be a tongue, or vice versa. Other patterns can be provided instead of the groove and tongue, for example patterns in the form of crosses or stars. In this manner, the rotational movement of the drive shaft 5 is transferred to the pull rod 4.

The traction movement of the rod is achieved by means of a draw sleeve 6 which is movable only in translation along the axis AA. The draw sleeve 6 is mechanically dissociated from the drive shaft 5, which enables a rotational movement or a traction movement to be applied independently on the crimp part.

Figure 4:
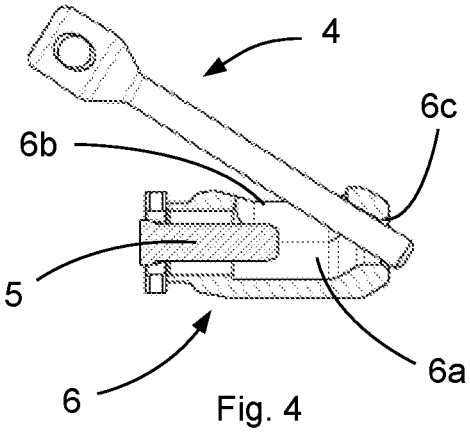
Figure 5:
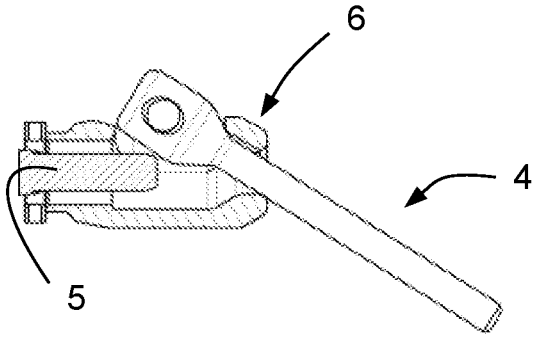

The draw sleeve 6 is a hollow part comprising a cavity 6*a* configured to house the front end of the drive shaft 5 and the rear end 4*b* of the pull rod 4. The cavity 6*a* of the draw sleeve 6 opens onto a first hole 6*b* at the level of the side wall, and onto a second hole 6*c* located in the extension of the axis AA. The first and second holes 6*b* and 6*c* enable the pull rod 4 to be inserted and fitted in place on the setting tool (cf. FIGS. 4 and 5).

The dimensions of the pull rod 4, of the cavity 6*a*, of the first hole 6*b* and of the second hole 6*c* are advantageously engineered so that the front end 4*a* of the rod can pass successively through the first hole 6*b* and second hole 6*c* when the pull rod passes through the cavity 6*a*, and so that the rear end 4*b* of the rod 4 can only pass through the first hole 6*b*. The rear end 4*b* of the pull rod 4 therefore has a larger cross-section than the front end 4*a*. The cross-section of the first hole 6*b* is also larger than the cross-section of the second hole 6*c*.

The form of the cavity 6*a* not only enables the pull rod 4 to be inserted in the cavity 6*a* of the draw sleeve 6, but also enables the pull rod 4 to be placed on the axis of rotation AA of the drive shaft 5. The pull rod 4 is therefore inserted in the draw sleeve 6 being located along an axis BB passing through the first and second holes 6*b* and 6*c* (cf. FIG. 2).

The draw sleeve 6 can further be configured so that the pull rod 4 is both movable in rotation along the axis AA relatively to the draw sleeve 6 and no longer has any degree of freedom in translation along the axis AA after it has been correctly positioned. This particularity enables perfectly symmetrical forces to be exerted on the crimp part when the tool is in operation, and therefore makes it possible to apply forces of greater intensity without any risk of damage to the setting tool or to the crimp part.

In an area 6*d* situated between the first and second holes 6*b* and 6*c*, the cavity 6*a* can have a complementary shape to that of the rear end 4*b* of the rod 4 in a cutting plane orthogonal to the axis of rotation AA. The fact that the pull rod 4 and draw sleeve 6 are assembled without clearance in the area 6*d* prevents movement of the rod 4 perpendicularly to the axis of rotation AA, after the latter has been correctly positioned in the cavity 6*a* and mechanically connected to the drive shaft 5.

In advantageous manner, the junction between the front part 4*a* and rear part 4*b* of the pull rod 4 forms a shoulder 4*c* configured to press on the cavity 6*a* in the area 6*d* so that the pull rod 4 and draw sleeve 6 are securedly attached in translation along the axis AA. The shapes of the shoulder 4*c* and of the area 6*d* of the cavity are advantageously tapered towards the rear so that a backward translation of the draw sleeve 6 results in a backward translation of the pull rod 4.

The shoulder 4*c* and the area 6*d* of the cavity 6*a* advantageously have complementary shapes and are rotationally symmetrical on the axis AA so that the rod 4 is movable in rotation along the axis AA whereas the draw sleeve 6 remains fixed. The fact that the shapes are complementary also enables tractive forces of high intensity to be exerted without the pull rod 4 being deformed when crimping is performed. Advantageously the shoulder 4*c* and area 6*d* can have the shape of a truncated cone (cf. FIGS. 2 and 6).

In advantageous manner, in an area 4*d* of the rear end 4*b*, the pull rod 4 does not present a rotational symmetry in a cutting plane orthogonal to the axis of rotation AA. This absence of symmetry facilitates fitting of the rod 4 between its insertion/extraction position and its position of use (cf. FIGS. 4 to 6).

Figure 6:
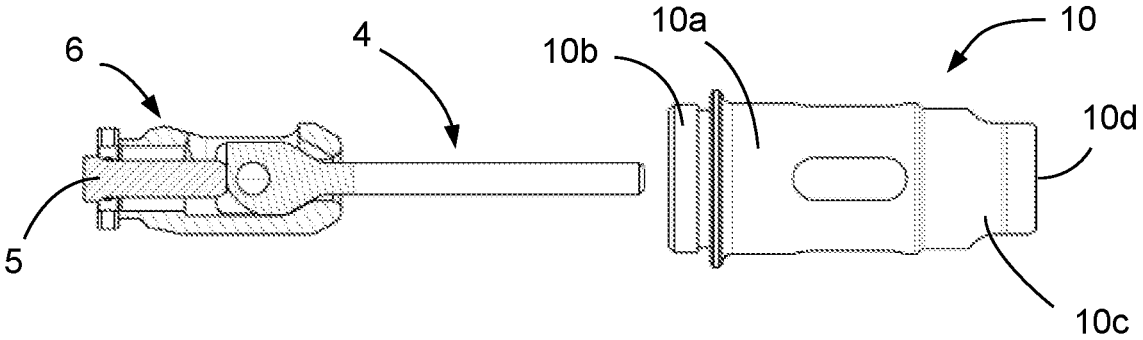

The area 4*d* of the rear end 4*b* can be bevelled to facilitate sliding in the cavity 6*a* (cf. FIGS. 2 and 6). The rear end of the cavity 6*a* can have a cross-section of complementary shape to that of the rod 4 or have a larger cross-section so as to leave a space after the pull rod 4 has been fitted.

To enable the pull rod 4 to be inserted in the cavity 6*a*, the first hole 6*b* advantageously presents a suitable shape. For example, if the rear end 4*b* of the pull rod 4 is cylindrical, the first hole 6*b* can be square or rectangular depending on the length of the rear end 4*b* along the axis AA. If the rear end 4*b* of the rod 4 is in the shape of a truncated cone, the first hole 6*b* can also be in the shape of a truncated cone. It can also be square or rectangular.

In general manner, the second hole 6*c* may not be symmetrically rotational on the axis AA (cf. FIG. 2). It can on the other hand have one or more planes of symmetry passing through the axis of rotation AA. The second hole 6*c* can have a tapered shape in proximity to the axis of insertion BB of the pull rod 4.

What is meant by proximity to the axis BB is the half-space opposite the first hole 6*b* the hemispherical plane of which passes through the axis AA. The second hole 6*c* can for example have an ovoid, oval-oblong, or ellipsoid cross-section.

According to a particular embodiment, the second hole 6*c* can have a circular cross-section the diameter of which is slightly larger than the diameter of the front end 4*a* of the pull rod 4. What is meant by slightly larger is that the diameter of the second hole 6*c* is at the most 5% larger than the diameter of the front end 4*a* of the rod 4.

For example purposes, the embodiment illustrated in FIG. 2 provides for the first hole 6*b* to be able to be positioned on the top part of the side wall of the draw sleeve 6 and for the second hole 6*c* to be able to comprise a tapered wall in its bottom part in order to facilitate passage of the pull rod 4. The second hole 6*c* is not circular as it comprises an additional clearance to allow insertion of the pull rod 4 in the first and second holes 6*b* and 6*c*, while passing through the cavity 6*a*. The additional clearance is arranged in the half-sphere passing through the axis of rotation AA, opposite the first hole 5*b*.

Assembly and removal of the pull rod 4 with/from the drive shaft 5 on the one hand and the draw sleeve 6 on the other hand is therefore facilitated and does not require the use of an external tool such as a mandrel. As the front end of the drive shaft 5 and the draw sleeve 6 are housed in the placing nose 2, the latter simply has to be dismantled to access the pull rod 4 to remove it.

Furthermore, the drive shaft 5 and draw sleeve 6 are actuated by two independent mechanisms. The drive shaft 5 is advantageously actuated by a motor (not shown) and transmits its torque to the pull rod 4 to make the latter rotate. The draw sleeve 6 can for its part be actuated by means of a hydraulic piston (not shown) which moves the assembly comprising the sleeve 6 and rod 4 backwards. The motor and hydraulic piston are both positioned inside the body 1 of the setting tool.

The motor and hydraulic piston are supplied by a power supply system housed in the body 1 that is able for example to be a pneumatic system comprising an inlet 7 and an outlet 8. The drive mechanism is controlled by means of a control device configured to actuate the pneumatic system in response to a pressure exerted by the user on a trigger 9.

For illustrative purposes, the user can for example press the trigger 9 up to mid-travel to perform screwing of the pull rod 4 on the crimp part. The motor is then started and makes the drive shaft 5 rotate, which makes the pull rod 4 rotate. The user can then press the trigger 9 to its full travel position to perform crimping of the crimp part. The hydraulic piston then makes the draw sleeve 6 translate, which has the effect of making the pull rod 4 translate and of performing the crimping.

In the embodiment presented in the figures, the placing nose 2 comprises a casing 10 the bottom part of which at least partially defines the chamber 3. The casing 10 preferably prevents access to the first hole 6*b*, which ensures user safety when the setting tool is in operation.

The placing nose 2 is fixed to the body 1 and can be detached from the body without any action being required on the pull rod 4. The placing nose 2 is decoupled from the movements of the drive shaft 5 and of the draw sleeve 6.

In the illustrated example, the casing 10 comprises a rear part 10*a* firmly engaged inside the body 1, and a collar 10*b* designed to be placed against the stop formed by the front surface of the body 1.

The casing 10 can be inserted in the body 1 by sliding, screwing or by other means. The part of the casing 10 that is salient from the body 1 may have a length which is able to be adjusted by the user of the setting tool.

The casing 10 can be fixed to the body 1 by means of a mechanical securing device. The latter comprises an opening situated on the front part of the body 1, a blind hole situated in the rear part 10*a* of the casing 10 located facing the opening, and a securing part inserted in the opening and placed against the stop formed by the bottom of the blind hole. The securing part is removable and can for example be a screw or a ball screw. The choice of a ball screw is particularly opportune as this type of component greatly reduces friction thereby limiting the wear of the opening and of the blind hole.

The placing nose 2 is also provided with an anvil 11 fixed to the front part 10*c* of the casing. For this purpose, the anvil 11 comprises a rear part 11*a* having a cross-section of identical width to a hole 10*d* of the front part 10*c* of the casing. The rear part 11*a* is advantageously threaded and the hole 10*d* threaded to enable the anvil 11 to be screwed into the casing 10. In this way, the anvil 11 is fitted movable on the casing 10, which limits the movement of the crimp part and therefore the deformation during crimping.

This configuration makes it possible to use a pull rod 4 of a given length over a wide range by displacing the position of the anvil 11. If on the other hand the anvil 11 is fixed, it is preferable to have pull rods 4 having different lengths to accommodate the dimensions of the crimp parts.

The anvil 11 also comprises a bevelled front part 11*b* in order to better withstand the force involved when crimping is performed, and an axial opening 11*c* to allow passage of the pull rod 4 salient on the front surface of the placing nose 2. The axial opening 11*c* advantageously has a complementary shape to that of the pull rod 4 to prevent any inopportune movement of the pull rod 4 with respect to the fixing axis of the crimp part. A specific anvil 11 for each diameter of pull rod 4 can consequently be provided if the pull rod performs coupling by threading. But it is possible to provide an anvil 11 similar to a mandrel able to be tightened by means of a suitable spanner.

The placing nose 2 is finally provided with an adjustment means 12 (cf. FIGS. 2, and 8 to 11) positioned between the casing 10 and anvil 11. This means can for example be a locknut designed to block the position of the rear part 11*a* of the anvil 11 in the hole 10*d* of the casing 10. In this way, the length of the part of the pull rod 4 able to be screwed onto the crimp part can be modified, which makes it possible to crimp parts having a rod which is more or less long. In alternative manner, the adjustment means 12 could be a set of shims of variable thicknesses.

In an alternative embodiment, the casing 10 and anvil 11 can be monoblock. However, this embodiment provides less possibilities of adjustment of the dimensions of the pull rod 4 and/or the crimp parts.

The structure of the setting tool presents the advantage of enabling the pull rod 4 to be changed without having to have recourse to any special tooling.

To change the pull rod 4, the placing nose 2 can in fact easily be dismantled by first unscrewing the anvil 11 from the hole 10*d* of the casing 10. The mechanical securing device can then be dismantled. This enables the casing 10 of the body 1 of the tool to be removed to gain access to the pull rod 4.

The pull rod 4 then simply has to be moved along the axis BB and be pushed to the outside of the first hole 5*b* in order to detach it from the drive shaft 5.

If the pull rod 4 comprises front and rear ends 4*a* and 4*b* in two parts, it can be envisaged to unscrew the front end 4*a* and to then fit another pull rod 4 on the same rear end 4*b*.

The new pull rod 4 is inserted in the cavity 6*a* of the draw sleeve 6 through the first hole 6*b* up to the second hole 6*c*, and then positioned on the axis of rotation AA (cf. FIGS. 3 to 7).

To prevent any inopportune movement of the pull rod 4 with respect to the drive shaft 5, the pattern placed on the rear surface of the rod 4 and the complementary pattern of the drive shaft 5 are assembled.

The placing nose 2 can then be reassembled. To do this, the casing 10 first has to be fitted on the body 1 and the two parts be secured to one another by means of the mechanical securing device (cf. FIG. 8). The adjustment means 12 is then positioned against the front surface of the casing 10, and an anvil 11 suitable for the new pull rod 4 is then screwed onto the casing 10 (cf. FIG. 9). The position of the adjustment means 12 can be chosen to adjust the travel of the pull rod 4 to the user's requirements. It is then possible to crimp a new crimp part (cf. FIGS. 10 and 11).

The invention is not limited to the features that have just been described. The setting tool can be used in association with a pull rod 4 formed by at least two parts. If the rod is formed in two parts, the rear end 4*b* then advantageously comprises a blind or through hole in which the front end 4*a* can be inserted. The two parts can be secured to one another by any suitable means, for example by screwing the front end 4*a* of the pull rod 4 into the hole of the rear end 4*b*. To improve the connection between the two parts, the hole can advantageously be filled with a cohesion means such as glue or a Teflon seal. This also results in vibrations being dampened and the axial compliance being enhanced.

As illustrated in the foregoing embodiments, the pull rod 4 comprises an imprint which collaborates with an imprint of the drive shaft 5 so that rotation of the drive shaft results in rotation of the pull rod 4.

In the illustrated embodiments, the imprint of the pull rod 4 is or comprises a groove enabling the pull rod 4 to be fitted in the sleeve 6 by sliding on the imprint present on the drive shaft 5. This embodiment does however leave scope for improvement in order to be able to increase the applicable forces.

It was observed that the sliding used to facilitate insertion of the pull rod can also give rise to certain difficulties of use. For example, it is not impossible to experience sliding of the pull rod which results in a displacement of its axis of rotation with respect to the axis of rotation of the drive shaft.

To improve the operation of the setting tool, it was observed that it is particularly advantageous to provide two imprints which prevent insertion of the pull rod by sliding on the drive shaft.

The imprint formed in the pull rod 4 is not a simple rectilinear groove to prevent sliding.

The pull rod 4 comprises a first imprint and the drive shaft 5 comprises a second imprint. The first and second imprints are configured to cause rotation of the pull rod 4 along the axis of rotation AA when the first and second imprints are mechanically coupled. The two imprints are also configured to prevent the pull rod 4 from being detached from the drive shaft 5 by sliding by means of a force perpendicular to the axis of rotation AA when the first and second imprints are mechanically coupled. What is meant by mechanical coupling is that one of the two imprints is inserted in the other imprint.

One of the two imprints can be a non-rectilinear groove, for example a curve. It is also possible to provide for one of the two imprints to comprise several grooves having different orientations. It is further possible to provide for one of the imprints to be a closed imprint, i.e. an imprint in the form of a hole which does not open onto the lateral external surface of the pull rod 4 or of the drive shaft. It is possible to combine these different embodiments in so far as collaboration of the imprint of the rod 4 with the imprint of the shaft 5 prevents sliding for fitting and removal of the rod 4.

Figure 18:
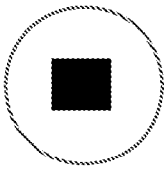
Figure 19:
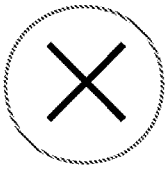
Figure 20:
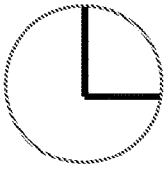

According to one embodiment, the imprint is a blind hole which is surrounded by a closed ring of material. The imprint of the shaft 5 is an element that is salient on the drive shaft 5. As an alternative, the imprint of the pull rod 4 is salient and the associated imprint of the drive shaft 5 is a hole. FIGS. 18 and 19 illustrate two embodiments of imprints that do not extend up to the side wall of the rod 4 or of the shaft 5. FIG. 20 illustrates an embodiment with a groove which extends up to the side wall of the rod 4 or of the shaft 5, one or more times.

In advantageous manner, the imprint is formed by a blind hole to improve the mechanical performances. In this way, transfer of the rotational movement of the drive shaft 5 to the pull rod 4 is enhanced.

This configuration provides a greater mechanical strength between the rod 4 and shaft 5, which also lifts the constraints on the maximum dimensions of the cavity 6*a* and of the different openings of the sleeve 6.

For example, the pattern present on the rear surface of the rod 4 is in the shape of a cross or a star. It can also be in the shape of a square, a rectangle, a triangle or in more general manner a polygon which may be regular or not. The pattern can also be of any shape and formed by one or more distinct elements which are salient and/or recessed.

Figure 13:
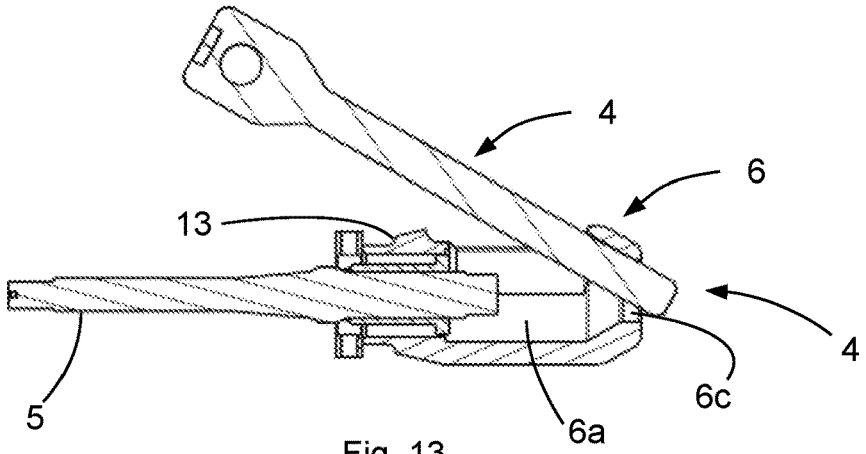
Figure 14:
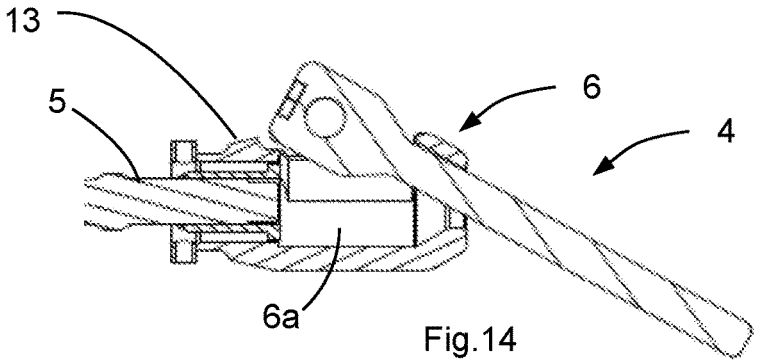
Figure 15:
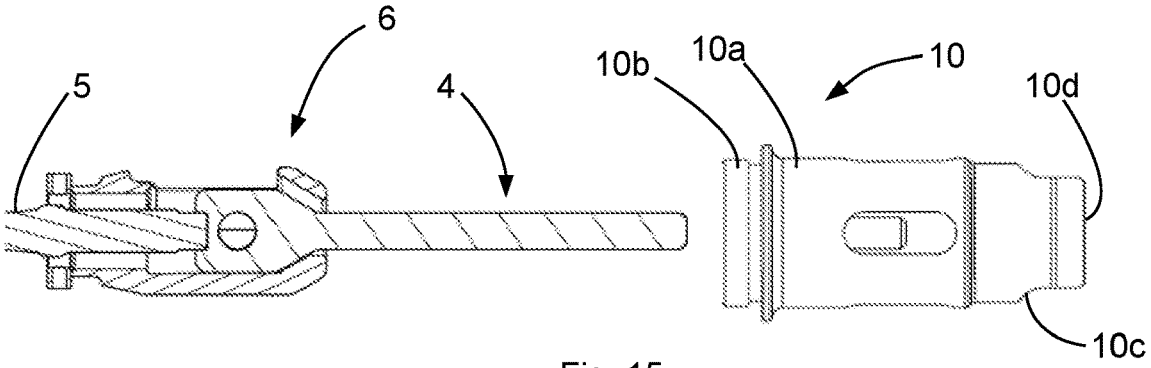
Figure 16:
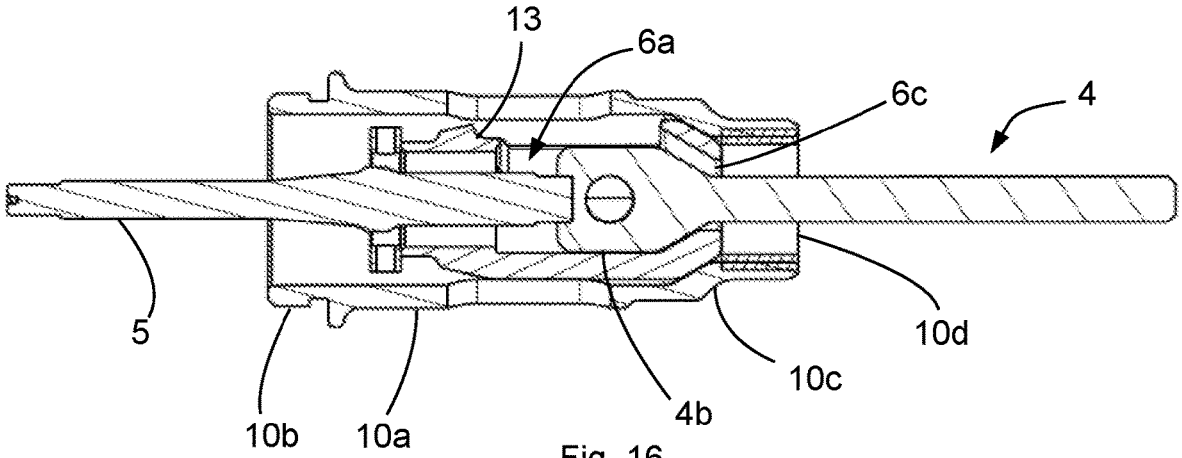
Figure 17:
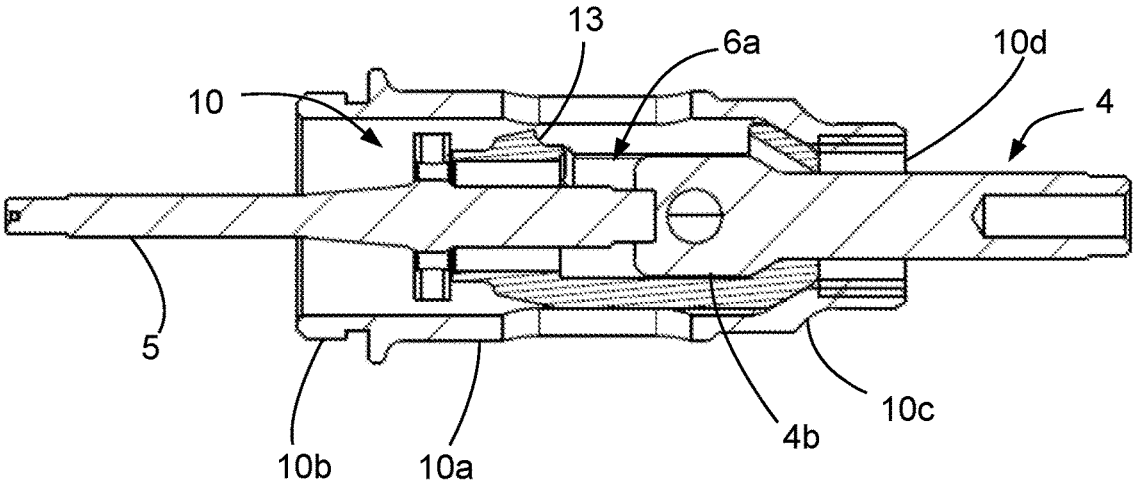

As can be seen in FIGS. 13, 14 and 15, in order to insert the pull rod 4 in the chamber 3 along the axis of rotation AA, the drive shaft 5 is movable in translation along its axis of rotation AA. With such a translational movement, it is easier to insert the pull rod 4 in the sleeve 6 to achieve the mechanical connection between the imprint of the pull rod 4 and the complementary imprint of the drive shaft 5 without dismantling the sleeve 6. This configuration is more advantageous than the use of a groove and tongue, as the risks of sliding in the course of operation are reduced which enables higher forces to be applied.

In advantageous manner, the axis of rotation of the pull rod 4 is an axis of symmetry of the imprint present in the pull rod and preferentially the axis of rotation of the pull rod 4 is an axis of symmetry of the imprint of the drive shaft 5. In a particular embodiment, the axis of rotation of the rod 4 is an axis of symmetry for the whole of the rear part of the rod 4, for example the whole of the part which is located in the sleeve 6.

In a particular embodiment illustrated in FIGS. 12 to 15, the end of the pull rod 4 presents a rounded peripheral edge in order to facilitate insertion of the pull rod 4 and to engage translation of the drive shaft 5. As an alternative, a part of the peripheral edge can be bevelled, but this means that the pull rod has to be placed more precisely with respect to the imprint of the shaft 5. In this particular case, insertion of the rod 4 is easier when the imprint of the rod is a hole. As an alternative, if the imprint of the rod is salient, it is advantageous to provide for the imprint to be bevelled.

Figure 12:
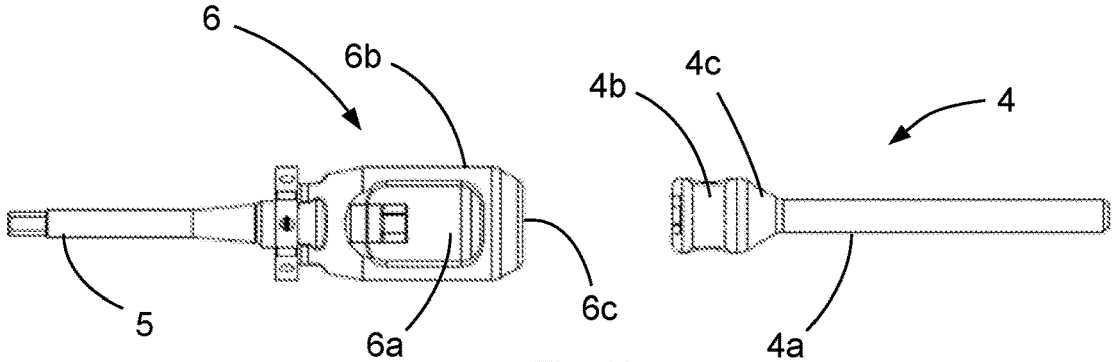
FIGS. 12 to 15 represent fitting steps of the placing nose of the tool according to another embodiment, FIGS. 16 and 17 schematically illustrate a longitudinal sectional view of the placing nose according to another embodiment with a threaded or tapped pull rod, FIGS. 18, 19 and 20 schematically illustrate coupling imprints of the pull rod with the drive shaft.

FIGS. 12 and 13 show insertion of the pull rod in the chamber 3 in identical manner to that which was presented for the previous embodiment. FIG. 14 shows that when insertion of the pull rod in the chamber takes place, the drive shaft 5 retracts, moving in a backward direction by means of a translation along the axis of rotation AA. This backward movement of the drive shaft 5 facilitates fitting of the pull rod 4 in the sleeve 6 as the volume available for performing the installation is larger.

FIG. 15 shows that once the pull rod 4 has been fitted in the sleeve 6, the drive shaft 5 moves forward so as to engage in the imprint of the pull rod 4. The forward movement is advantageously configured to wedge the pull rod 4 against the inner surface of the sleeve 6 along the axis of rotation of the pull rod 4. The risks of undesired movement in the sleeve 6 are thereby greatly reduced.

In one embodiment, the drive shaft 5 is moved backwards manually, for example by pressing on the shaft 5 by means of the pull rod 4 in a direction perpendicular to the axis AA. As an alternative, the drive shaft 5 is moved by means of a lug. The user applies a pressure on the lug either directly or indirectly in order to move it backwards and facilitate fitting of the rod 4.

In another embodiment that is not represented, the backward movement of the drive shaft 5 is performed in mechanical manner, for example by means of a motor which moves the drive shaft 5 forwards or backwards along the axis of rotation AA.

In a particular embodiment, the rear surface of the pull rod 4 is configured so as not to allow backward movement of the drive shaft 5 when the pull rod 4 applies a force different from a translation along the axis AA and directed towards the rear. In other words, the rounded section or the bevel present on the rear surface of the rod 4 does not exist and/or does not cooperate with the drive shaft 5 to engage a backward translation. Backward movement of the drive shaft 5 cannot be achieved by simple insertion of the rod in the sleeve 6.

To remove the pull rod 4 from the sleeve 6, it is advantageous to provide a lug on the drive shaft 5 in order to move the drive shaft 5 backwards. The movement of the drive shaft 5 is performed to separate the imprint which exists on the shaft 5 from the imprint which exists on the pull rod 4. The pull rod 4 can thus be retracted to make it come out of the sleeve 6. Withdrawal can be performed by moving the pull rod 4 to align it with the axis BB and by then moving the rod 4 to the outside of the chamber 3 through the first hole 6*a* of the sleeve 6.

There again, the backward movement of the shaft 5 can be performed manually or not and with the same embodiments as previously.

When rotation takes place, the lug moves inside the sleeve 6. Sufficient space necessary for this rotation has to be provided.

The lug can be formed by one or more studs salient from the surface of the pull rod 4. As an alternative, the lug can be formed by a rim which runs completely around the drive shaft 5.

In a first exemplary case, the lug is located inside the cavity 6*a*. However, it is more advantageous to provide for the lug to be located outside the cavity and/or for it to cooperate with an actuator which is located outside the cavity. In FIGS. 13 to 15, a button 13 is present on the surface of the sleeve 6. The button 13 comes into contact with the lug present on the drive shaft 5 to engage withdrawal of the shaft 5. In this way, the user can move the shaft 5 backwards before inserting the rod 4 in the sleeve 6 and/or to prevent the rod 4 from forcing on the drive shaft 5 when performing fitting of the rod 4.

In an alternative embodiment, the lug is replaced by an opening. The opening cooperates with an additional tool to perform movement of the drive shaft 5 along the axis AA.

Different configurations can be envisaged—in advantageous manner, the drive shaft 5 is secured in the sleeve 6 by means of a bearing which reduces the lateral movement of the shaft 5 in a direction perpendicular to the axis AA.

In advantageous manner, the imprint present in the pull rod 4 and the imprint present in the drive shaft 5 define a functional clearance which facilitates insertion of the imprints in one another.

The two imprints can comprise a salient or recessed imprint identical to the associated imprint which is respectively recessed or salient. It is also possible to have an imprint having a different shape compatible for performing driving in rotation.

The invention claimed is:

1. A setting tool for a crimp part, the setting tool comprising:

a body, a drive shaft, a pull rod, a draw sleeve, and a placing nose, wherein the drive shaft is connected to the pull rod and the pull rod is designed to be screwed onto the crimp part, the pull rod comprising a front end and a rear end, the rear end of the pull rod having a larger cross-section than the front end of the pull rod, a front end of the drive shaft connects the rear end of the pull rod, a rotation of the drive shaft about an axis causes rotation of the pull rod about the axis, the draw sleeve comprises a rear end fixed to the body and is connected to the pull rod, the draw sleeve being connected to the rear end of the pull rod, a translation of the draw sleeve along the axis causes translation of the pull rod along the axis, the placing nose comprises a rear end fixed to the body and an opposite front end, the placing nose defining an inner open chamber opening out at both the front end and the rear end, the chamber being configured to house the rear end of the pull rod, the front end of the drive shaft, and the draw sleeve, the draw sleeve comprises a cavity housing the rear end of the pull rod, the cavity opening onto a first through hole defined on a side wall of the draw sleeve, and a second through hole on the axis, the pull rod being removable with respect to the draw sleeve via the first through hole, the front end of the pull rod passing through the second through hole and the pull rod being arranged rotated around the axis of rotation of the drive shaft.

2. The setting tool according to claim 1, wherein a rear wall of the pull rod defines a pattern collaborates with a complementary pattern of the drive shaft.

3. The setting tool according to claim 1, wherein the draw sleeve defines the second through hole by means of a first surface, said first surface not defining a surface of revolution around the axis.

4. The setting tool according to claim 1, wherein the pull rod comprises a shoulder having a complementary shape to a shape of the draw sleeve, the shape and the complementary shape being tapered towards the rear end of the draw sleeve.

5. The setting tool according to claim 4, wherein the shoulder has a rotational symmetry around axis, and wherein the draw sleeve is mechanically dissociated from the drive shaft so that the draw sleeve remains fixed when a rotation of the pull rod takes place around the axis.

6. The setting tool according to claim 1, wherein the placing nose comprises a casing inside which the chamber is located, an anvil positioned at a front end of the placing nose, and adjuster configured to adjust a travel of the pull rod, the adjuster being placed between the casing and the anvil and configured to block relative position of the anvil with respect to the casing.

7. The setting tool according to claim 6, wherein the adjuster is formed by a locknut.

8. The setting tool according to claim 1, wherein the pull rod comprises a first imprint and the drive shaft comprises a second imprint, the first and second imprints being configured:

to make the pull rod rotate about the axis when the first and second imprints are mechanically coupled, to prevent the pull rod from being separated from the drive shaft by sliding by means of a force perpendicular to the axis of rotation when the first and second imprints are mechanically coupled.

9. The setting tool according to claim 8, wherein one of the first and second imprints is a cross or a star.

10. The setting tool according to claim 8, wherein one of the first and second imprints is in the form of a polygon.

11. The setting tool according to claim 8, wherein the drive shaft is mounted movable in translation along the axis to couple or uncouple the first imprint with/from the second imprint.

12. A method for assembling a setting tool, comprising the following steps:

providing the setting tool according to claim 6, inserting the pull rod in the cavity of the draw sleeve through the first through hole up to the second through hole, placing the pull rod along the axis, connecting the pull rod to the drive shaft, fixing the placing nose on the body.

13. The method for assembling according to claim 12, comprising an adjustment step of the adjuster on the casing so as to limit the travel of the pull rod.

14. The method for assembling according to claim 12, wherein a rear wall of the pull rod defines a pattern configured to collaborate with a complementary pattern of the drive shaft and comprising an assembly step of the pattern and of the complementary pattern.

15. The method for assembling according to claim 12, wherein the pull rod comprises a first imprint and the drive shaft comprises a second imprint and comprising a first step of translation of the drive shaft along the axis of rotation of the drive shaft to reduce space occupied by the drive shaft along the axis and to place the pull rod on the axis so as to mechanically couple the first imprint with the second imprint.

16. The method for assembling according to claim 15, comprising a second step of translation of the drive shaft along the axis of rotation of the drive shaft to couple the first imprint with the second imprint.

* * * * *